US006902514B2

(12) United States Patent
Chuang

(10) Patent No.: US 6,902,514 B2
(45) Date of Patent: Jun. 7, 2005

(54) SWINGING EXERCISER HAVING ROTATABLE FOOT PEDALS

(76) Inventor: Jin Chen Chuang, P.O. Box 63-99, Taichung (TW), 406

( * ) Notice: Subject to any disclaimer, the term of this patent is extended or adjusted under 35 U.S.C. 154(b) by 246 days.

(21) Appl. No.: 10/298,533

(22) Filed: Nov. 19, 2002

(65) Prior Publication Data

US 2004/0097336 A1 May 20, 2004

(51) Int. Cl.[7] ..... A63B 22/00; A63B 22/14
(52) U.S. Cl. ..... 482/52; 482/147
(58) Field of Search ..... 482/51, 52, 53, 482/146, 147, 70, 79, 80

(56) References Cited

U.S. PATENT DOCUMENTS

| | | | | | |
|---|---|---|---|---|---|
| 3,650,528 | A | | 3/1972 | Natterer | 272/57 B |
| 4,390,180 | A | | 6/1983 | Simjian | 272/126 |
| 5,078,389 | A | | 1/1992 | Chen | 272/70 |
| 5,407,408 | A | | 4/1995 | Wilkinson | 482/54 |
| 5,433,690 | A | | 7/1995 | Gilman | 482/146 |
| 5,453,065 | A | | 9/1995 | Lien et al. | 482/52 |
| 5,599,262 | A | * | 2/1997 | Shih | 482/147 |
| 5,632,711 | A | * | 5/1997 | Hwang | 482/147 |
| 5,695,439 | A | * | 12/1997 | Lin | 482/146 |
| 5,888,176 | A | | 3/1999 | Kuo | 482/53 |
| 5,888,182 | A | * | 3/1999 | Shih | 482/147 |
| 5,908,373 | A | * | 6/1999 | Pitre | 482/57 |
| 5,924,961 | A | | 7/1999 | Kuo et al. | 482/52 |

* cited by examiner

*Primary Examiner*—Stephen R. Crow
(74) *Attorney, Agent, or Firm*—Charles E. Baxley

(57) ABSTRACT

An exerciser includes a handle and a supporting device rotatably secured to a base, two foot pedals are rotatably secured to the support with spindles for allowing the users' feet to be rotated relative to the supporting device and for preventing the users from being hurt or twisted while rotating relative to said base with the supporting device. A device may couple the the handle to the supporting device for allowing the handle to be rotatably coupled to the supporting device. The handle may include a shank rotatably and foldably secured to a lower segment.

5 Claims, 6 Drawing Sheets

SWINGING EXERCISER HAVING ROTATABLE FOOT PEDALS

BACKGROUND OF THE INVENTION

1. Field of the Invention

The present invention relates to an exerciser, and more particularly to a swinging exerciser having rotatable foot pedals.

2. Description of the Prior Art

Various kinds of typical exercisers have been developed for conducting various operations or exercises. For example, U.S. Pat. No. 3,650,528 to Natterer discloses an exerciser for conducting swinging or skiing operations. The users' feet may not be rotated relative to the support thereof.

U.S. Pat. No. 4,390,180 to Simjian, U.S. Pat. No. 5,407,408 to Wilkinson, U.S. Pat. No. 5,433,690 to Gilman disclose three other exercisers which may be used for conducting rotating or swinging operations only. In addition, a single circular plate is provided for supporting the feet of the users, and includes a tiny space or area such that the feet of the users may not be suitably separated or opened from each other. Furthermore, the users may only rotate or twist their waist portion with a limited rotational angle.

U.S. Pat. No. 5,078,389 to Chen discloses another exerciser which may be used for conducting rotating and swinging and stepping operations. However, similarly, a single tiny circular plate is provided for supporting the feet of the users, such that the feet of the users may not be suitably separated or opened from each other.

U.S. Pat. No. 5,888,176 to Kuo, and U.S. Pat. No. 5,924,961 to Kuo et al. disclose two further typical exercisers which may be used for conducting stepping operation, and which includes a rotatable handle for allowing the users to twist their upper portions. However, the feet of the users may not be rotated or twisted relative to the handle, such that the rotational movement of the users is limited.

U.S. Pat. No. 5,453,065 to Lien et al. discloses a still further typical exerciser including a stepper mechanism rotatably supported on a support frame, a base body rotatably attached to the support frame, and having a pair of spaced pedal arms that have one end rotatably secured to an upright front portion, such that the exerciser includes a complicated configuration and a great cost. Similarly, the feet of the users also may not be rotated or twisted relative to the handle.

The present invention has arisen to mitigate and/or obviate the afore-described disadvantages of the conventional exercisers.

SUMMARY OF THE INVENTION

The primary objective of the present invention is to provide a swinging exerciser having rotatable foot pedals for rotatably and separately supporting the feet of the user and for allowing the user's feet to suitably rotated relative to the support and for preventing the user's feet from being twisted or hurt by the support.

In accordance with one aspect of the invention, there is provided an exerciser comprising a base including a shaft provided thereon, a supporting device rotatably secured to the base with the shaft, and including a beam having two separate orifices formed therein, two spindles rotatably engaged into the orifices of the beam respectively, and separated from each other, and two foot pedals secured to the spindles and thus rotatably secured to the beam with the spindles, for rotatably and separately supporting users' feet. The foot pedals may be rotatable relative to the beam when the beam of the supporting device is rotated relative to the base, for preventing the users' feet from being twisted or hurt by the beam while conducting the rotating or swinging operations or exercises.

The supporting device includes a seat rotatably secured to the base with the shaft, and the beam includes a middle portion secured to the seat and two end portions having the orifices formed therein for rotatably supporting the spindles of the foot pedals respectively.

A handle device may further be provided and secured to the base, for supporting upper portion of users, and includes a lower segment rotatably secured to the base with a pin, and includes a shank rotatably secured to the lower segment with a pivot rod, and means for selectively securing the shank to the lower segment of the handle device.

A device may further be provided for coupling the the handle device to the supporting device and includes a first rotary member attached to the supporting device, and a second rotary member attached to the handle device and coupled to the first rotary member.

The coupling means further includes a coupling member engaged over the first and the second rotary members for rotatably coupling the first and the second rotary members together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
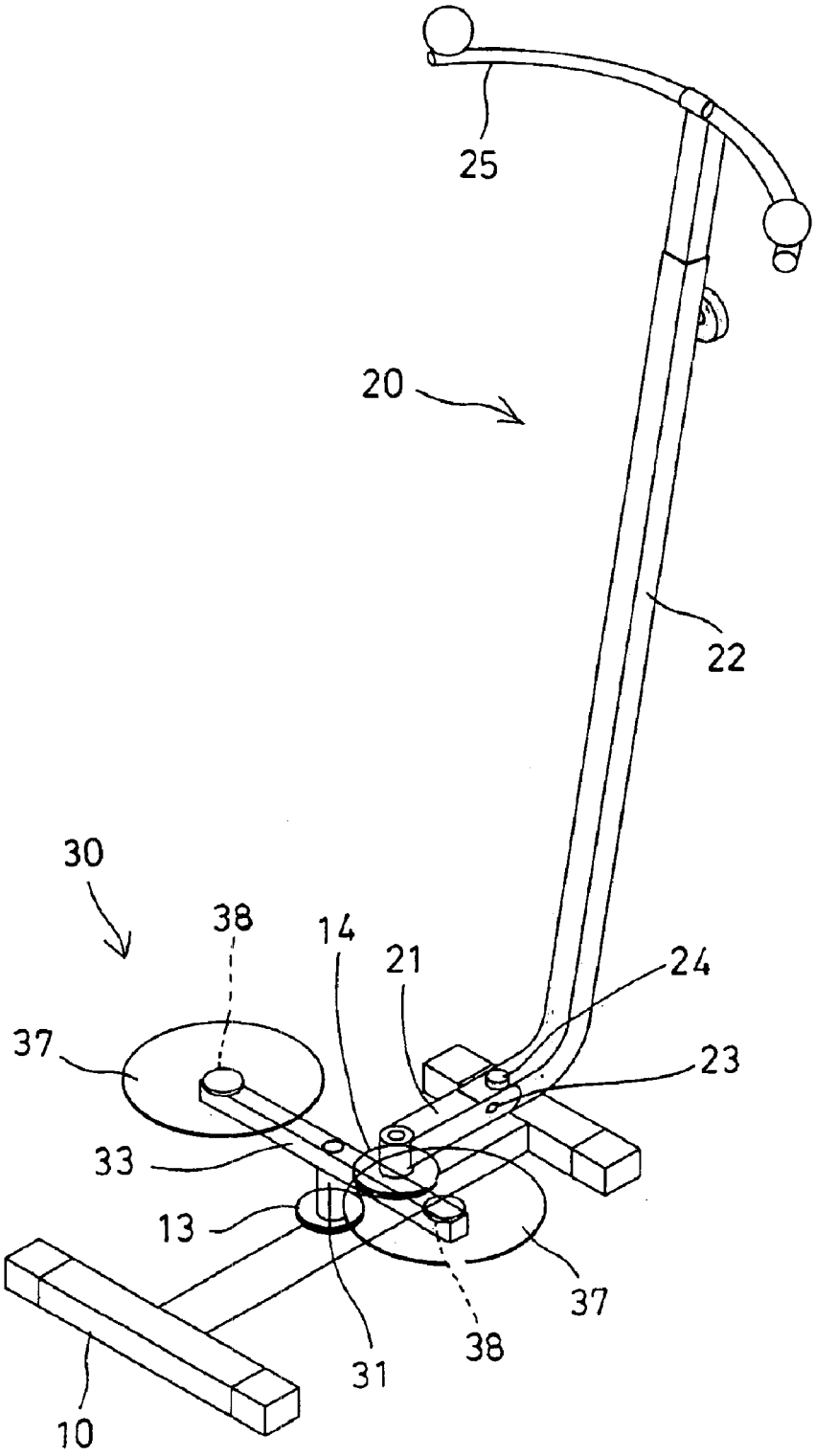
FIG. 1 is a perspective view of an exerciser in accordance with the present invention.
Figure 2:
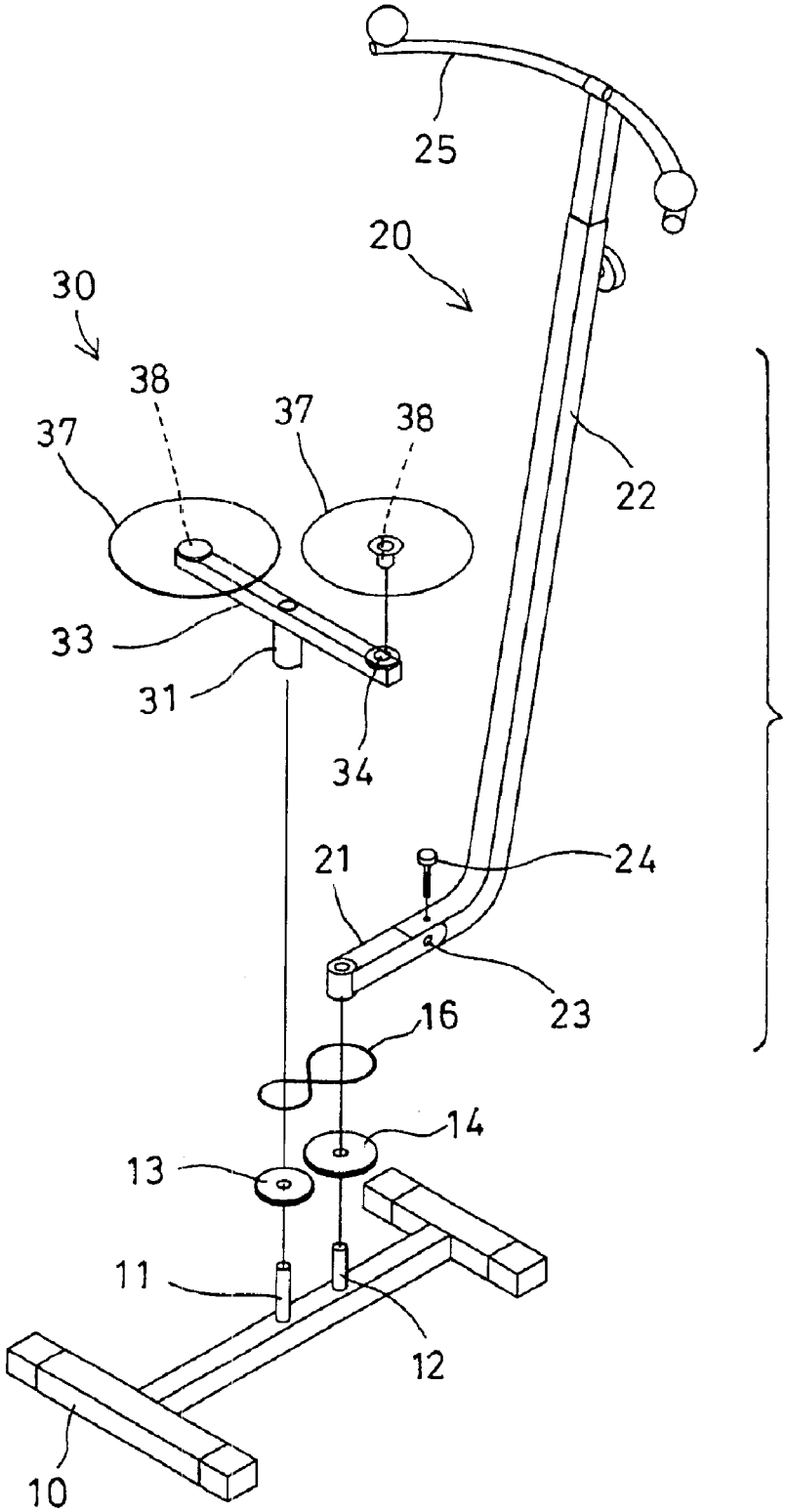
FIG. 2 is a partial exploded view of the exerciser.
Figure 3:
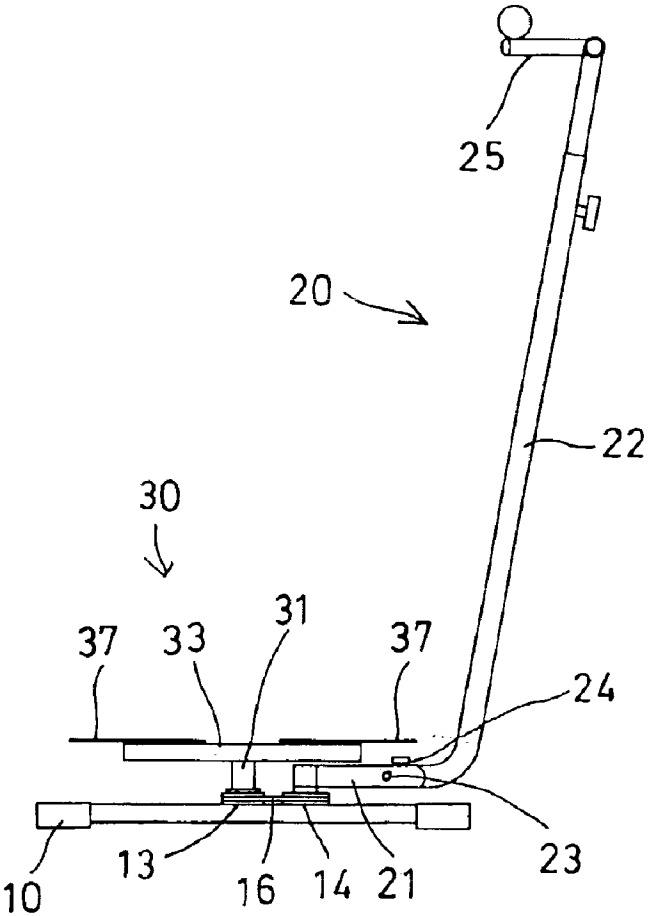
FIG. 3 is a side view of the exerciser.
Figure 7:
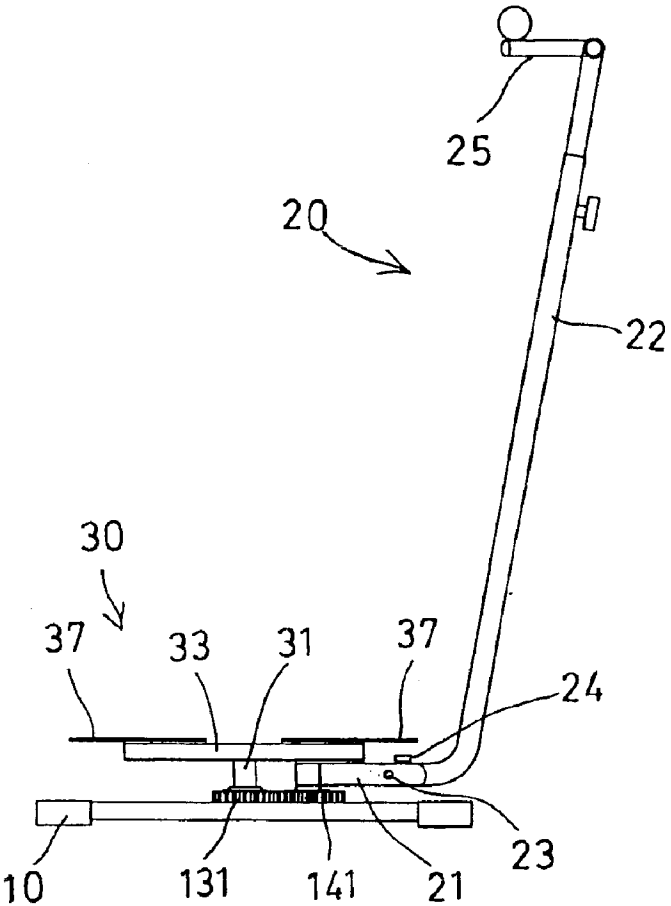
FIG. 7 is a side view of the exerciser as shown in FIGS. 5 and 6.
Figure 8:
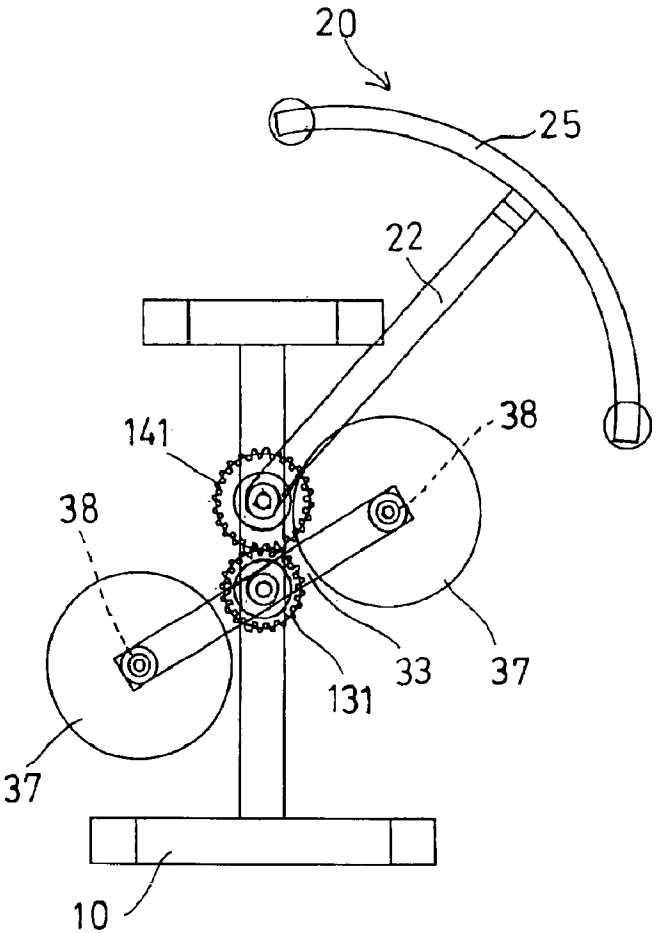
FIG. 8 is a top plan view of the exerciser as shown in FIGS. 5–7.
Figure 4:
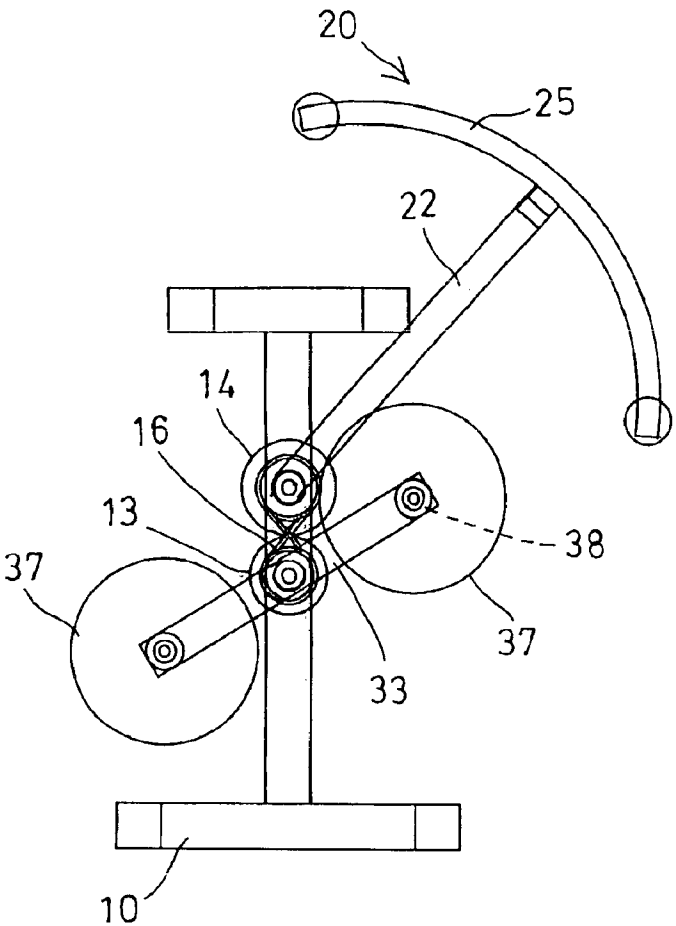
FIG. 4 is a top plan view of the exerciser.
Figure 5:
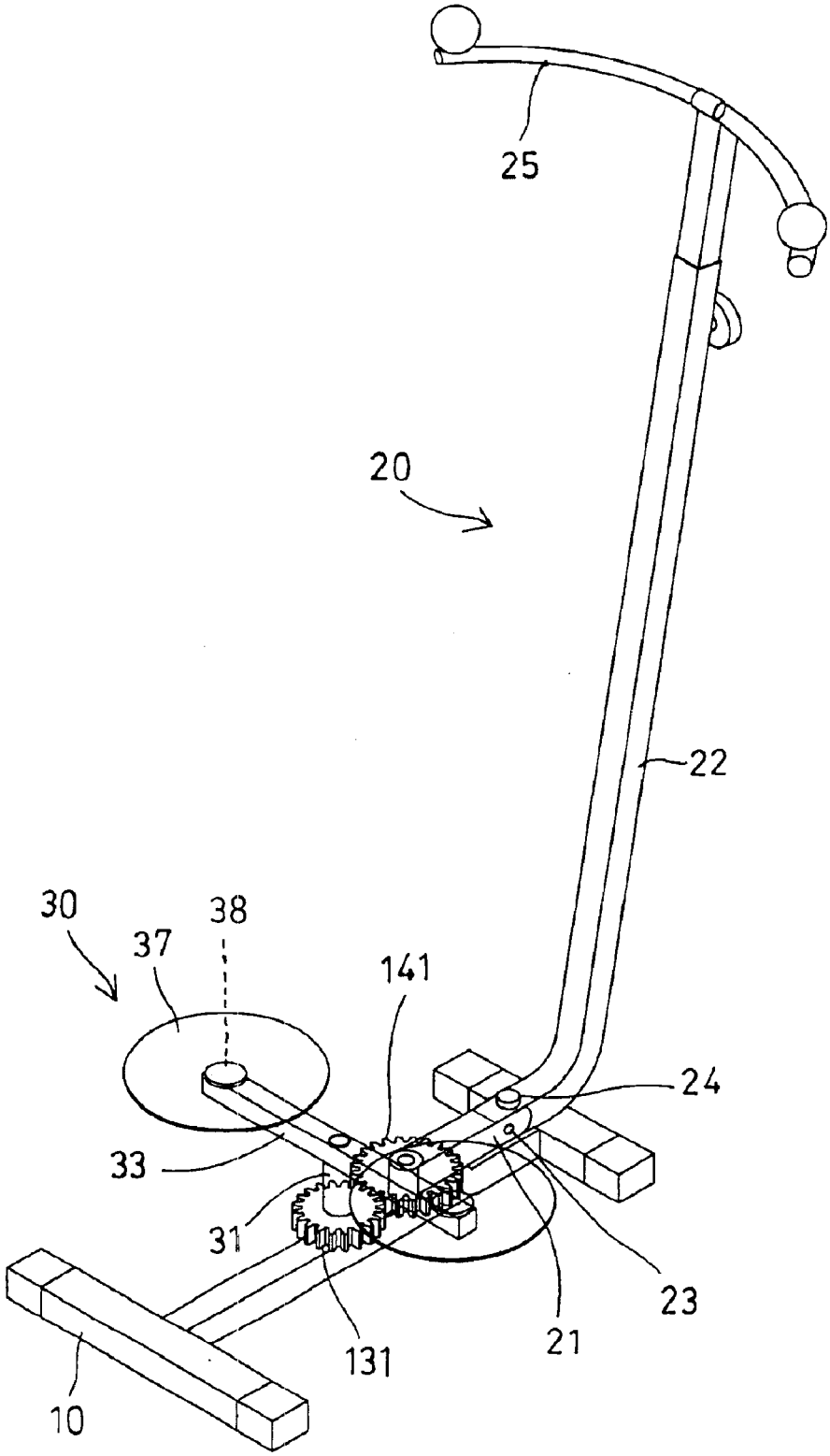
FIG. 5 is a perspective view illustrating another arrangement of the exerciser.
Figure 6:
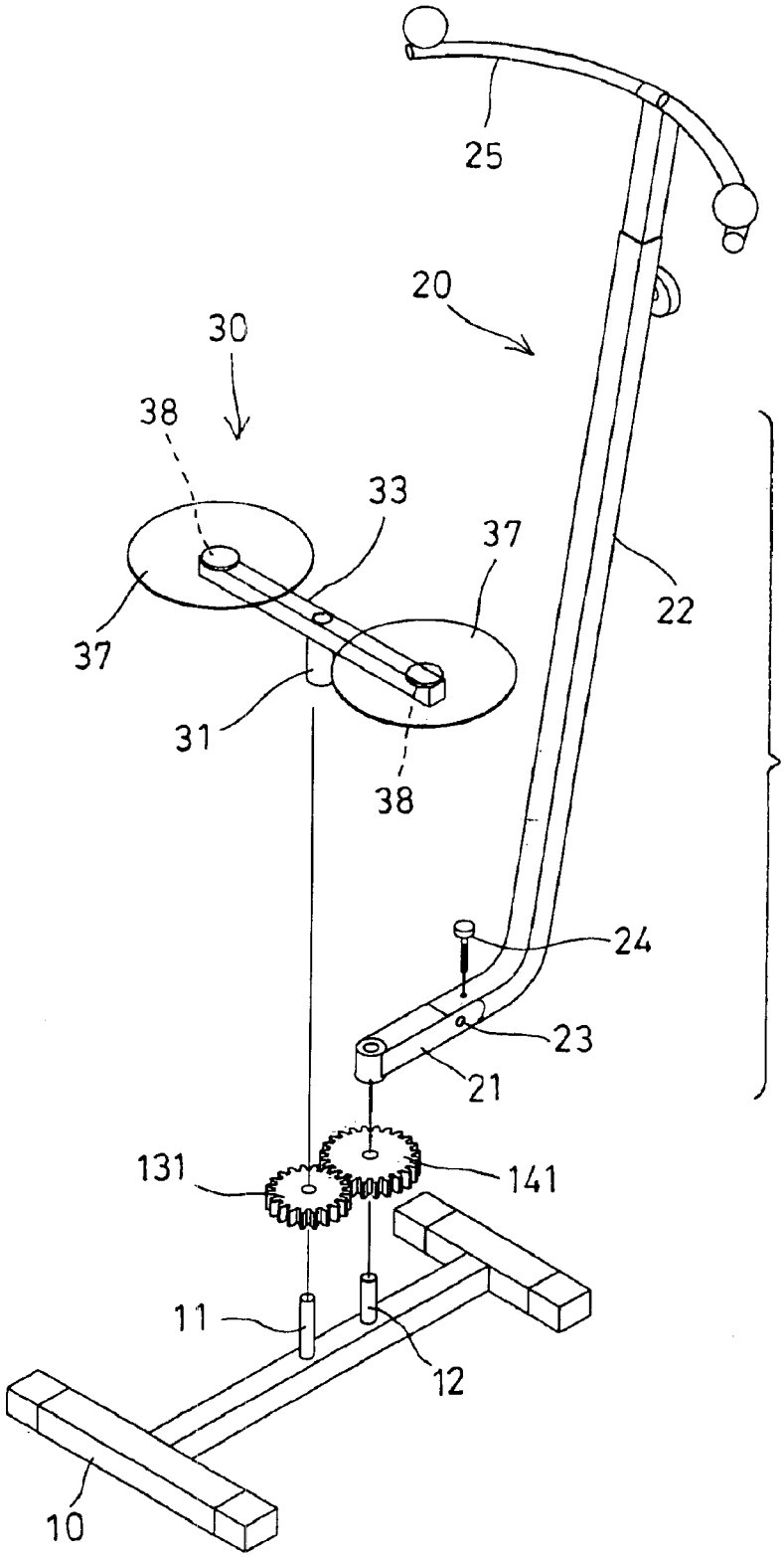
FIG. 6 is an exploded view of the exerciser as shown in FIG. 5.

Referring to the drawings, and initially to FIGS. 1–4, an exerciser in accordance with the present invention comprises a base 10 including a shaft 11 and a pin 12 provided thereon, such as upwardly extended therefrom, two rotary members 13, 14 rotatably secured on the shaft 11 and the pin 12 respectively and coupled together with a coupling member 16, such as a belt or a cable 16 or the like.

For example, the rotary members 13, 14 may be the disks or the pulleys 13, 14 and rotatably coupled together with a belt, a cable 16 or the like, for allowing the pulleys 13, 14 to be rotatably coupled together with the cable 16.

Alternatively, as shown in FIGS. 5–8, the rotary members 13, 14 may be gears 131, 141, and may be directly engaged with each other.

A handle device 20 is provided for supporting the upper portion of the users, and includes a lower segment 21 rotatably or pivotally engaged onto the pin 12, and preferably secured to the rotary member 14, for allowing the handle device 20 to be rotated in concert with the rotary member 14, and includes a shank 22 having a hand grip 25 adjustably provided on top thereof.

For example, the shank 22 of the handle device 20 includes a lower portion rotatably secured to the lower segment 21 with a pivot rod 23, and releasably secured to the lower segment 21 with a fastener 24, which may secure the shank 22 at an upright or working position relative to the lower segment 21 as shown in FIG. 1.

A rotatable supporting device 30 includes a seat 31 rotatably or pivotally engaged onto the shaft 11, and preferably secured to the rotary member 13, for allowing the rotatable supporting device 30 to be rotated in concert with the rotary member 13, and for allowing the rotatable supporting device 30 to be rotatably coupled to the handle device 20 with the rotary members 13, 14 and the cable 16.

The rotatable supporting device 30 further includes a beam 33 having a middle portion secured to the seat 31, and having two ends each having an orifice 34 formed therein (FIG. 2), or having two separate orifices 34 formed therein.

Two foot pedals 37 each includes a spindle 38 extended therefrom and rotatably engaged into the orifices 34 of the beam 33, such that the foot pedals 37 may be rotatably secured on the beam 33 with the respective spindles 38, and such that the foot pedals 37 may be separated from each other, for separately supporting the feet of the users.

In operation, when the rotatable supporting device 30 is rotated relative to the base 10 about the shaft 11 by the user, the foot pedals 37 may also be rotated relative to the beam 33, such that the feet of the user may be rotated relative to the beam 33, and will not be twisted or hurt by the beam 33.

In addition, the users may also rotate the rotatable supporting device 30 in order to rotate the handle device 20 and to swing or twist the users' waist portion via the rotary members 13, 14 and the cable 16. Relatively, the users may also rotate the handle device 20 relative to the base 10, in order to rotate the rotatable supporting device 30.

It is to be noted that the foot pedals 37 are rotatably secured or supported on the beam 33, for separately and rotatably supporting the feet of the users, and for allowing the feet of the users to be comfortably supported on the foot pedals 37.

A longer fastener 24 may be engaged through the handle device 20 and the base 10, in order to secure the handle device 20 to the base 10, and for preventing the support device 30 from being rotated relative to the base 10.

Alternatively, the rotary members 13, 14 and the coupling member 16 may be removed from the base 10, and the rotatable supporting device 30 and the handle device 20 may be freely and rotatably secured onto the base 10 with the shaft 11 and the pin 12 respectively, for allowing the rotatable supporting device 30 and the handle device 20 to be randomly rotated relative to the base 10 with the shaft 11 and the pin 12 respectively.

Accordingly, the exerciser in accordance with the present invention includes rotatable foot pedals for rotatably and separately supporting the feet of the user and for allowing the user's feet to suitably rotated relative to the support and for preventing the user's feet from being twisted or hurt by the support.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a shaft provided thereon, a supporting device rotatably secured to said base with said shaft, and including a beam having two separate orifices formed therein, two spindles rotatably engaged into said orifices of said beam respectively, and separated from each other, two foot pedals secured to said spindles and thus rotatably secured to said beam with said spindles, for rotatably and separately supporting users' feet, said foot pedals being rotatable relative to said beam when said beam of said supporting device is rotated relative to said base, and a handle device secured to said base, for supporting upper portion of users, said handle device including a lower segment rotatably secured to said base with a pin, and said handle device including a shank rotatably secured said to said lower segment with a pivot rod, and means for selectively securing said shank to said lower segment of said handle device.

2. The exerciser according to claim 1, wherein said supporting device includes a seat rotatably secured to said base with said shaft, and said beam includes a middle portion secured to said seat and two end portions having said orifices formed therein for rotatably supporting said spindles of said foot pedals respectively.

3. The exerciser according to claim 1 further comprising means for coupling said handle device to said supporting device.

4. The exerciser according to claim 3, wherein said coupling means includes a first rotary member attached to said supporting device, and a second rotary member attached to said handle device and coupled to said first rotary member.

5. An exerciser comprising:

a base including a shaft provided thereon, a supporting device rotatbly secured to said base with said shaft, and including a beam having two separate orifices formed therein, two spindles rotatably engaged into said orifices of said beam respectively, and separated from each other, two foot pedals secured to said spindles and thus rotatably secured to said beam with said spindles, for rotatably and separately supporting users' feet, said foot pedals being rotatable relative to said beam when said beam of said supporting device is rotated relative to said base, a handle device secured to said base, for supporting upper portion of users, and means for coupling said handle device to said supporting device, said coupling means including a first rotary member attached to said supporting device, and a second rotary member attached to said handle device and coupled to said first rotary member, and said coupling means further includes a coupling member engaged over said first and said second rotary members for rotatably coupling said first and second rotary members together.

* * * * *